United States Patent [19]

Barnes, Jr. et al.

[11] Patent Number: 4,458,754

[45] Date of Patent: Jul. 10, 1984

[54] METHOD AND SYSTEM FOR AUTOMATICALLY RAISING PRODUCT FROM A HEATED WELL

[75] Inventors: Vernon M. Barnes, Jr., Houston; Mark D. Looney, Missouri City; Matthew J. Riddiford, Beaumont, all of Tex.

[73] Assignee: Texaco Inc., White Plains, N.Y.

[21] Appl. No.: 403,883

[22] Filed: Jul. 30, 1982

[51] Int. Cl.[3] ..... E21B 43/12

[52] U.S. Cl. ..... 166/250; 166/372; 166/53; 166/64

[58] Field of Search ..... 166/372, 369, 250, 53, 166/64, 65 R, 75 R; 417/109, 142, 139

[56] References Cited

U.S. PATENT DOCUMENTS

| | | | |
|---|---|---|---|
| 1,754,945 | 4/1930 | Huskell | 166/372 |
| 3,191,681 | 6/1965 | Hubby | 166/250 |
| 3,212,579 | 10/1965 | Cryer | 166/250 |
| 4,211,279 | 7/1980 | Isaacks | 166/372 |
| 4,352,376 | 10/1982 | Norwood | 166/53 |
| 4,355,365 | 10/1982 | McCracken | 166/64 |

*Primary Examiner*—James A. Leppink
*Assistant Examiner*—Timothy David Hovis
*Attorney, Agent, or Firm*—Robert A. Kulason; Carl G. Ries; Henry C. Dearborn

[57] ABSTRACT

A method or system for raising gas and liquid from a well used in in situ heating of a formation. Such heating may be done by radio frequency having an appropriate wave length in the earth e.g. about fifteen meters. The well has a production tube suspended from the well head. And, the method steps include sweeping the annulus with dry gas to drive the products up the production tube, at low flow. Also, another step is that of measuring the pressure differential between the annulus and the outlet of the production tube. And, another step is that of increasing the flow of the dry gas whenever the pressure differential exceeds a predetermined minimum. The increased flow is continued for an interval long enough to clear the liquid product that has risen in the tube and caused the differential pressure increase.

6 Claims, 1 Drawing Figure

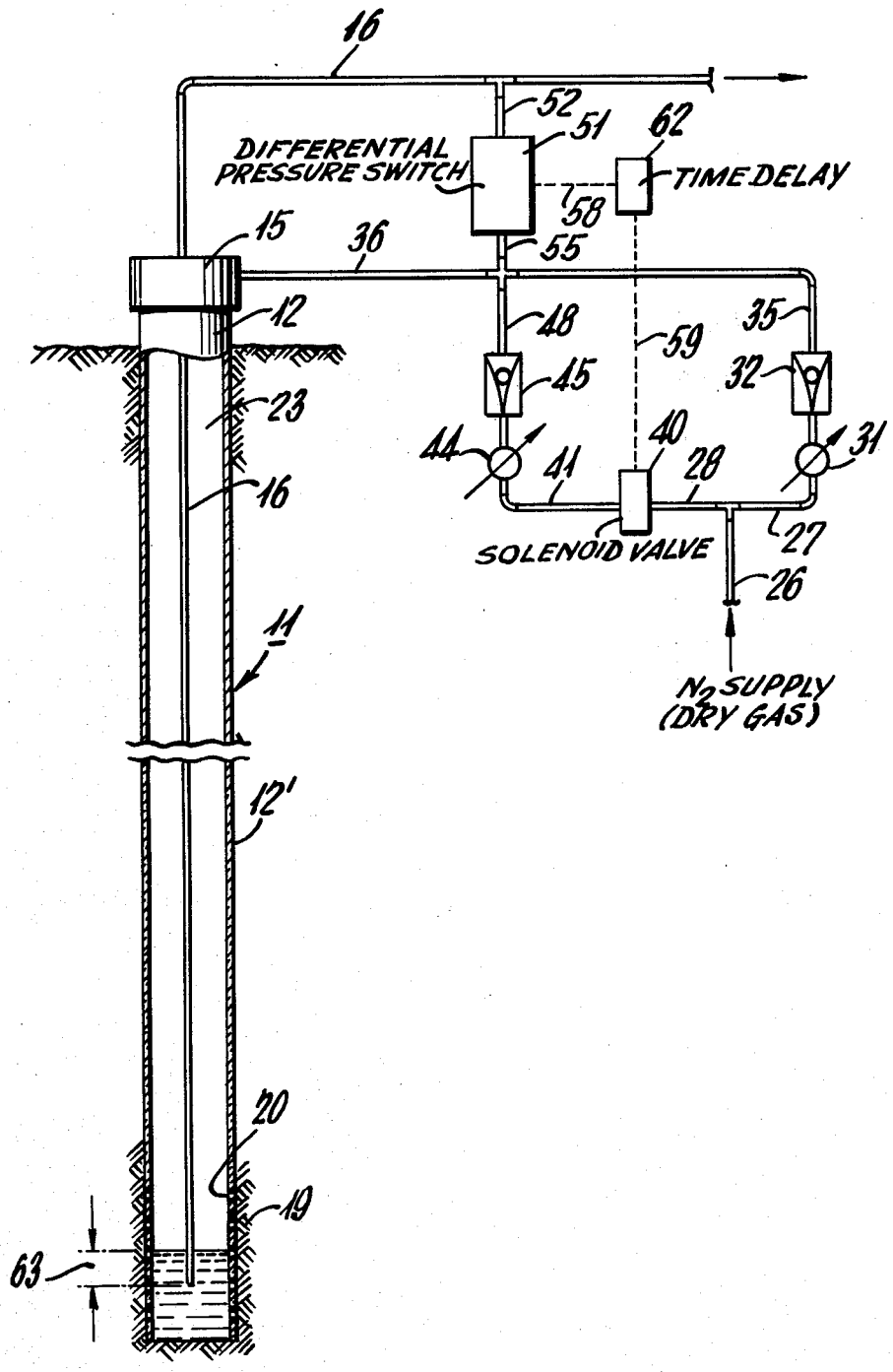
16
52
51
62
DIFFERENTIAL PRESSURE SWITCH
TIME DELAY
58
15
36
55
12
48
59
35
45
32
23
44
41
40
28
31
16
SOLENOID VALVE
27
26
11
N2 SUPPLY (DRY GAS)
12'
20
19
63

METHOD AND SYSTEM FOR AUTOMATICALLY RAISING PRODUCT FROM A HEATED WELL

BACKGROUND OF THE INVENTION

1. Field of the Invention

This invention concerns a gas-lifting procedure, in general. More specifically, it deals with a procedure for gas-lifting products from a well that is used in an in situ heating procedure for producing petroleum products.

2. Description of the Prior Art

Gas-lift systems of different sorts have been used and known for many years in connection with producing liquids, particularly oil, from low pressure wells. For example, there is U.S. Pat. No. 3,054,358, to Merlyn et al, issued Sept. 18, 1962, which discloses a system that applies high pressure gas to the annulus of a well and has a pressure measuring element at the top of the well to measure the gas pressure therein. The system includes a gas-lift valve that is connected to a production tubing down in the hole. That valve will open when the level of fluid in the well reaches a particular height above it. The valve opening then permits high pressure gas (from the annulus) to force the fluid into the tubing and up the well. It does that until the gas pressure in the annulus has fallen to some particular low level. When that happens, a valve at the surface is opened to apply high pressure gas to the annulus once more, after sufficient time delay to allow the downhole gas-lift valve to close. Then, the increase of gas pressure in the annulus will act on the pressure measuring element at the top of the well so as to begin another cycle.

However, the system of that patent must employ a downhole gas-lift valve which is connected to the production tube. And, in addition, that patent system is not applicable to a method or system according to this invention because it introduces only high pressure gas to the well.

SUMMARY OF THE INVENTION

Briefly, the invention concerns a method of raising produced gas liquid and liquid vapors from an in situ heated well having a production tube therein extending into said well. The method comprises the steps of sweeping said well with a dry gas down the annulus around said production tube at a low flow rate, and measuring the pressure difference between said annulus sweep gas and said produced gas and liquid vapors. It also comprises increasing the flow of said dry gas when said pressure difference exceeds a predetermined minimum in order to carry accumulated liquid up said production tube.

Again briefly, the invention concerns a system for automatically raising products from an in situ heated well, the said well having a production tube therein suspended from a well head and forming an annulus around said tube beneath said well head. The system comprises a supply of dry oxygen free gas under pressure for sweeping said well to carry products out therewith, and a first needle valve and first conduit means for connecting said first needle valve between said gas supply and said annulus to provide a continuous low flow product sweep. It also comprises means for measuring the pressure difference between said annulus and the outlet of said production tube, and for actuating a switch when said pressure difference exceeds about five pounds per square inch. It also comprises a solenoid valve and second conduit means having a second needle valve connected therein for connecting a parallel path for said gas supply to said annulus through said second needle valve in order to shift said gas flow from said low product sweep to high flow for carrying accumulated liquid up said production tube. It also comprises time delay means associated with said switch for holding said solenoid valve open for an empirically determined interval sufficient to clear said accumulated liquid from said production tube.

BRIEF DESCRIPTION OF THE DRAWING

The foregoing and other objects and benefits of the invention will be more fully set forth below in connnection with the best mode contemplated by the inventors of carrying out the invention, and in connection with which there are illustrations provided in the drawing, wherein:

The FIGURE of drawing is a schematic showing of a system to which the method according to this invention applies.

DESCRIPTION OF THE PREFERRED EMBODIMENTS

A procedure has been developed where use is made of radio frequency heating, e.g. a high intensity electromagnetic field having a wave length of about fifteen meters in the earth. Heating units are introduced downhole in a formation (such as oil shale) where the product is difficult to extract. And, the effect is an in situ heating that changes hydrocarbons contained in a sub-surface formation into a fluid state. However, it has been found that the petroleum products which are thus produced must then be dealt with for raising the products to the surface.

A very efficient and inexpensive system and method in accordance with this invention has been developed in order to remove the petroleum products, which may include gas and vapors in addition to liquids. Thus, the drawing FIGURE illustrates a well 11 that may have a casing 12, at least near the upper portion of the well 11. Also, there is a well head structure 15 from which a production tube 16 is suspended.

Near the bottom of the well 11, it penetrates a formation 19 that may be oil shale or the like. Formation 19 is heated in situ either by adjacent wells (not shown) or otherwise, in order to have the petroleum constituents become vaporized and/or a liquid. Such products will flow through perforations 20 in the casing 12' if the casing extends all the way down to the formation 19, in which case ceramic casing will be used. Otherwise, of course, the products may flow directly into the well 11. And, there is an annulus 23 that is formed between the production tube 16 and the walls of the well 11.

At the surface, near the well 11, there is a supply of nitrogen or other dry gas suitable for sweeping products up hole. Such a supply is indicated by the caption "$N_2$ supply". Such dry gas supply is connected to a conduit 26 which branches into two other conduits 27 and 28. The conduit 27 leads to a needle valve 31 that has the other side thereof connected to a flow meter 32. From the other side of the flow meter 32 there is a conduit 35 and another conduit 36 which together connect the gas supply via the needle valve 31 and flow meter 32, into the well head 15. Here, it connects into the annulus 23. It will be understood that at the well head 15 the production tube 16 is connected through a cap structure (not shown) at the well head so that the inside of the well 11, i.e. the annulus 23, is closed from the atmosphere at the surface.

The conduit branch 28 (from conduit 26) connects the sweep gas supply to a solenoid valve 40. This valve 40 controls the flow of dry gas from the conduit 28 to another conduit 41 that is connected to another needle valve 44, the other side of which is connected to another flow meter 45. The other side of the flow meter 45 is connected to a conduit 48 that is connected directly into the conduits 35 and 36 so that the gas flow through the solenoid valve (when open) will go to and join the flow of gas already going through conduit 36. Of course the flow through the conduit 36 is into the annulus 23 of the well 11.

There is a differential pressure switch 51 that is schematically indicated with the caption applied. The differential pressure being measured by this switch is the difference between the pressure in the upper end of the production tube 16 and the pressure in the annulus 23. The pressure in production tube 16 goes to the switch 51 by a connecting conduit 52, while the pressure in the annulus 23 goes to switch 51 by a conduit 55 that joins the conduits 35 and 36 as well as conduit 48, all of which connect into the annulus 23. The differential switch 51 acts as a control element in an arrangement that is indicated by dashed lines 58 and 59 and which includes a time delay element 62. The arrangement may take various forms which are well known to those skilled in the art. And, it will be set up so that the time delay element 62 will act to hold the solenoid valve 40 actuated for a predetermined time delay following the initial actuation to open the valve 40 when called for by the differential pressure switch 51.

Method

The method according to this invention deals with raising of produced gas, liquid, and liquid vapors from a borehole that has been made in a formation, such as oil shale, where the product developed is released by heating in situ. In order to recover such products, the borehole, or well, will have a production tube inserted therein and supported from a well head structure. The well head is closed so as to seal the annulus of the well (around the production tube) from the atmosphere at the surface.

The steps of a method according to this invention may be described in connection with the drawing FIGURE. Such steps which include the following, are not necessarily carried out in the order described. A beginning step is that of sweeping the well with nitrogen or any suitable dry gas which is introduced into the annulus around the production tube, at a low flow rate. Thus, with reference to the drawing, the sweep gas from supply conduit 26 flows via the conduit 27 and the needle valve 31 plus the flow meter 32, and through conduits 35 and 36 to the well head 15 where it enters the annulus 23. Then this low flow of dry sweep gas goes down the annulus 23, and at the bottom of the well 11 it enters the production tube 16 and flows up through the tube to the surface. This sweeps any gas and/or vapor products with it out of the well 11.

However, if liquid gathers in the bottom of the well and covers the bottom of the production tube 16, the dry (sweeping) gas flow will be cut off. Consequently, a pressure difference will build up between the pressure in the annulus 23 and the pressure in the production tube 16, at the surface.

A next step is that of measuring the pressure difference between the dry sweep gas in the annulus and the produced gas at the top of the production tube. This may be accomplished by the differential pressure switch 51. It will be understood that there are a number of different pressure actuated switches commercially available which can meet the requirements called for. And, by adjustment or design the switch 51 which is connected via conduits 55 and 52 to receive the pressures from the annulus 23 and the production tube 16 at the surface, respectively, will measure the difference and be actuated when a predetermined differential has been reached.

A next step is to increase the flow of the dry sweep gas when the pressure difference exceeds about five pounds per square inch. The pressure difference is caused by and will be equal to a head of liquid 63 which has accumulated in the production tube 16. This increase of the flow is carried out by having the differential pressure switch 51 control actuation of the solenoid valve 40. This is done with the time delay element 62 included in such actuation so as to maintain the solenoid valve 40 actuated for a given length of time, as will be indicated hereafter. The solenoid valve 40 when actuated, opens so as to permit sweep gas flow from the supply (via conduit 26) to go via the branching conduit 28, through the solenoid valve 40 and conduit 41, to the other needle valve 44. Then through the flow meter 45 to the conduit 48 and thereafter to join the flow from the low flow branch (conduits 27 and 35) into the conduit 36. Then it flows via the well head 15 to the annulus 23. This increased flow will build sweep gas pressure in the annulus 23 sufficiently to produce a differential that is above the differential five pounds per square inch being measured by the switch 51. Consequently, it will force the liquid in the bottom of the production tube 16, up through the tube and out to the facilities (not shown) for gathering of products at the surface.

A next step is the maintaining of the increased flow for a long enough time to clear the accumulated liquid from the production tube. It will be appreciated that this time duration is determined by the time delay element 62 which may be one of many different commercially available elements. It should be noted that the time duration is adjusted in an empirical manner so as to have the time interval long enough to clear the liquid that is being forced up through the production tube 16, out of the tube at the surface.

It will be appreciated that the foregoing steps will be repeated in an automatic manner, whenever the head of liquid 63 which gathers in the bottom of the production tube 16, exceeds the predetermined pressure, i.e. about five pounds per square inch.

It will be understood that the elements shown in block form, i.e. the differential switch 51 and time delay element 62 as well as the solenoid valve 40, might take various different forms. And, the particular elements employed will be a matter of choice for any one skilled in the art.

It may be noted that in connection with an in situ heating procedure of the type contemplated, the well is essentially dry and it is desirable to maintain the downhole pressure as near to atmospheric as is practical. Consequently, a method according to this invention avoids the possibility of having the production tube 16 fill up to a level that would require undesirable pressure, e.g. approximately forty-three pounds per square inch per one hundred feet of depth, to clear it.

While this invention has been described in relation to a procedure for recovering products from formations below the surface that are heated in situ by radio frequency electromagnetic energy, it will be understood that the method may be applicable to other arrangements where a borehole accumulates products that are to be raised to the surface. The method involves a minimum of simple equipment and is a very economical and efficient way of recovering produced products from a borehole.

While particular embodiments of the invention have been described above in considerable detail in accordance with the applicable statutes, this is not to be taken as in any way limiting the invention but merely as being descriptive thereof.

We claim:

1. Method of raising produced gas liquid and liquid vapors from an in situ heated well having a production tube therein extending into said well, comprising the steps of sweeping said well with dry nitrogen down the annulus around said production tube at a low flow rate, measuring the pressure difference between said sweeping nitrogen in the annulus and said produced gas at top of said production tube, increasing the flow of said dry nitrogen in response to said pressure difference when said pressure difference exceeds about five pounds per square inch caused by an equal head of said liquid accumulating in said production tube, maintaining said increased flow long enough to clear said accumulated liquid from said production tube, and repeating said steps whenever said equal head of liquid accumulates.

2. System for automatically raising products from an in situ heated well, said well having a production tube therein suspended from a well head and forming an annulus around said tube beneath said well head, comprising a supply of dry gas for sweeping said well to carry products out therewith, means for connecting said dry gas supply to said annulus for a low flow rate out said production tube, means for measuring the pressure difference between said annulus and the outlet of said production tube, means for shifting said dry gas flow rate in response to said pressure difference from low to high when said pressure difference exceeds a predetermined minimum, and means for continuing said high flow rate until said production tube has been cleared of accumulated liquid.

3. System according to claim 2 wherein said means for connecting for low flow, comprises a valve, and conduit means for connecting said valve between said dry gas supply and said annulus.

4. System according to claim 3, wherein said means for shifting, comprises a second valve, and additional conduit means for connecting a parallel path between said dry gas supply and said annulus.

5. System according to claim 4, wherein said means for continuing said high flow rate, comprises means for actuating said second valve when said pressure difference exceeds said minimum, and time delay means for holding said valve open for a predetermined interval.

6. System for automatically raising products from an in situ heated well, said well having a production tube therein suspended from a well head and forming an annulus around said tube beneath said well head, comprising a supply of dry oxygen free gas under pressure for sweeping said well to carry products out therewith, a first needle valve and first conduit means for connecting said first needle valve between said gas supply and said annulus to provide a continuous low flow product sweep, a switch, means for measuring the pressure difference between said annulus and the outlet of said production tube and for actuating said switch in response to said pressure difference when said pressure difference exceeds about five pounds per square inch, a solenoid valve and second conduit means having a second needle valve connected therein for connecting a parallel path for said gas supply to said annulus through said second needle valve to shift said gas flow from said low product sweep to high flow for carrying accumulated liquid up said production tube, and time delay means actuated by said switch for holding said solenoid valve open for an empirically determined interval sufficient to clear said accumulated liquid from said production tube.

* * * * *